US008331843B2

(12) United States Patent
Nakazawa et al.

(10) Patent No.: US 8,331,843 B2
(45) Date of Patent: Dec. 11, 2012

(54) TONER RECOVERY UNIT AND IMAGE FORMING DEVICE

(75) Inventors: Shinji Nakazawa, Osaka (JP); Hideaki Kadowaki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 708 days.

(21) Appl. No.: 12/508,795

(22) Filed: Jul. 24, 2009

(65) Prior Publication Data

US 2010/0021204 A1 Jan. 28, 2010

(30) Foreign Application Priority Data

Jul. 28, 2008 (JP) ..... 2008-192937
Jul. 28, 2008 (JP) ..... 2008-192938

(51) Int. Cl.
*G03G 21/10* (2006.01)

(52) U.S. Cl. ..... 399/358; 399/120

(58) Field of Classification Search ..... 399/35, 399/358, 360, 120
See application file for complete search history.

(56) References Cited

U.S. PATENT DOCUMENTS 5,594,541 A * 1/1997 Bonislawski et al. ..... 399/358
6,882,821 B2 * 4/2005 Jeong et al. ..... 399/358
7,020,428 B2 * 3/2006 Park et al. ..... 399/360
7,391,990 B2 * 6/2008 Fujii et al. ..... 399/107
7,515,838 B2 * 4/2009 Kadowaki et al. ..... 399/13
7,620,358 B2 * 11/2009 Kadowaki et al. ..... 399/358
7,848,667 B2 * 12/2010 Ishi ..... 399/35
2007/0065196 A1 * 3/2007 Baker et al. ..... 399/358
2007/0196149 A1 8/2007 Sato et al.

FOREIGN PATENT DOCUMENTS

JP 2001318570 A * 11/2001
JP 2002014542 A * 1/2002
JP 2002049287 A * 2/2002
JP 2002169440 A * 6/2002
JP 2005-077513 3/2005
JP 2006-139151 6/2006
JP 2007-218936 A 8/2007
JP 2007-219453 8/2007
JP 2008225362 A * 9/2008

* cited by examiner

*Primary Examiner* — Sophia S Chen
(74) *Attorney, Agent, or Firm* — Nixon & Vanderhye P.C.

(57) ABSTRACT

This toner recovery unit is detachable installed to an image forming device, and includes a waste toner storage tank, a frame, opening/closing members, and a shift member. The frame is formed with discharge outlets and with a discharge passage which communicates those discharge outlets to the waste toner storage tank. The opening/closing members are rotated to opened positions in which they communicate the discharge outlets to the discharge passage, and to closed positions in which they interrupt such communication. And, along with the shift member shifting from an engagement release position in which its end portion does not engage with a fixing knob to an engagement position in which it engages the fixing knob, it rotates the opening/closing members from their opened positions to their closed positions.

13 Claims, 12 Drawing Sheets

TONER RECOVERY UNIT AND IMAGE FORMING DEVICE

CROSS REFERENCE

This Nonprovisional application claims priority under 35 U.S.C. §119(a) on Patent Application No. 2008-192938 filed in Japan on Jul. 28, 2008 and Patent Application No. 2008-192937 filed in Japan on Jul. 28, 2008 the entire contents of which are hereby incorporated by reference.

BACKGROUND OF THE TECHNOLOGY

Generally, an image forming device is provided with a toner recovery unit which retrieves waste toner which has not been transferred from a photoreceptor drum to a recording medium at a transfer process. This type of toner recovery unit is detachably installed to the device body, and, when maintenance is being performed, if the amount of toner which has been retrieved has reached a certain constant amount, then the toner recovery unit is removed from the device body and exchanged.

As disclosed in Japanese Laid-Open Patent Publication 2005-77513, there is one prior art type of toner recovery unit which includes a waste toner recovery vessel, a fixation lever, a shutter, and a biasing spring. The waste toner recovery vessel stores waste toner. The fixation lever selectively fixes the waste toner recovery vessel to the device body. The shutter opens and closes an discharge outlet on the device body for the waste toner. And the biasing spring biases the shutter from its opened position towards its closed position.

When the waste toner recovery vessel is pushed into the device body, the shutter is shifted from its closed position to its open position against the biasing force of the biasing spring. And, at an discharge outlet of the device body, the waste toner recovery vessel is fixed by the fixing lever to the device body, with an intake aperture of the waste toner recovery vessel opposing the discharge outlet.

However, with the toner recovery unit disclosed in the Patent Document, when installing the waste toner recovery vessel to the device body, it is necessary to perform the operation of fixing the waste toner recovery vessel with the fixing lever while pushing the waste toner recovery vessel against the resistance of the biasing force of the biasing spring, and there is the problem that this task is complicated and troublesome.

Moreover, since the intake aperture is not provided with any shutter, it is easy for waste toner stored in the reservoir unit to spill out from the intake aperture when the waste toner recovery vessel is taken off from the device body.

The object of the present technology is to provide a toner recovery unit and an image forming device with which, along with it being possible to perform the task of fitting a reservoir unit which stores waste toner to the device body in a simple and easy manner, it is also possible to prevent leakage of waste toner out from the reservoir unit.

SUMMARY OF THE TECHNOLOGY

The toner recovery unit of the present technology is detachably installed to a device body having a plurality of discharge outlets through which toner is discharged and an engagement portion which engages with the toner recovery unit, and includes a storage unit, a frame member, first opening/closing members, and a shift member. The storage unit stores toner. The frame member is formed with a discharge passage which connects the discharge outlets to the reservoir unit. The first opening/closing members are displaced between opened positions in which they communicate the plurality of discharge outlets to the discharge passage, and closed positions in which they do not communicate the plurality of discharge outlets to the discharge passage. And, when it shifts, the shift member displaces the first opening/closing members from their opened positions to their closed positions, along with biasing the engagement member from its engagement release position to its engagement position.

DETAILED DESCRIPTION OF THE TECHNOLOGY

Figure 1:
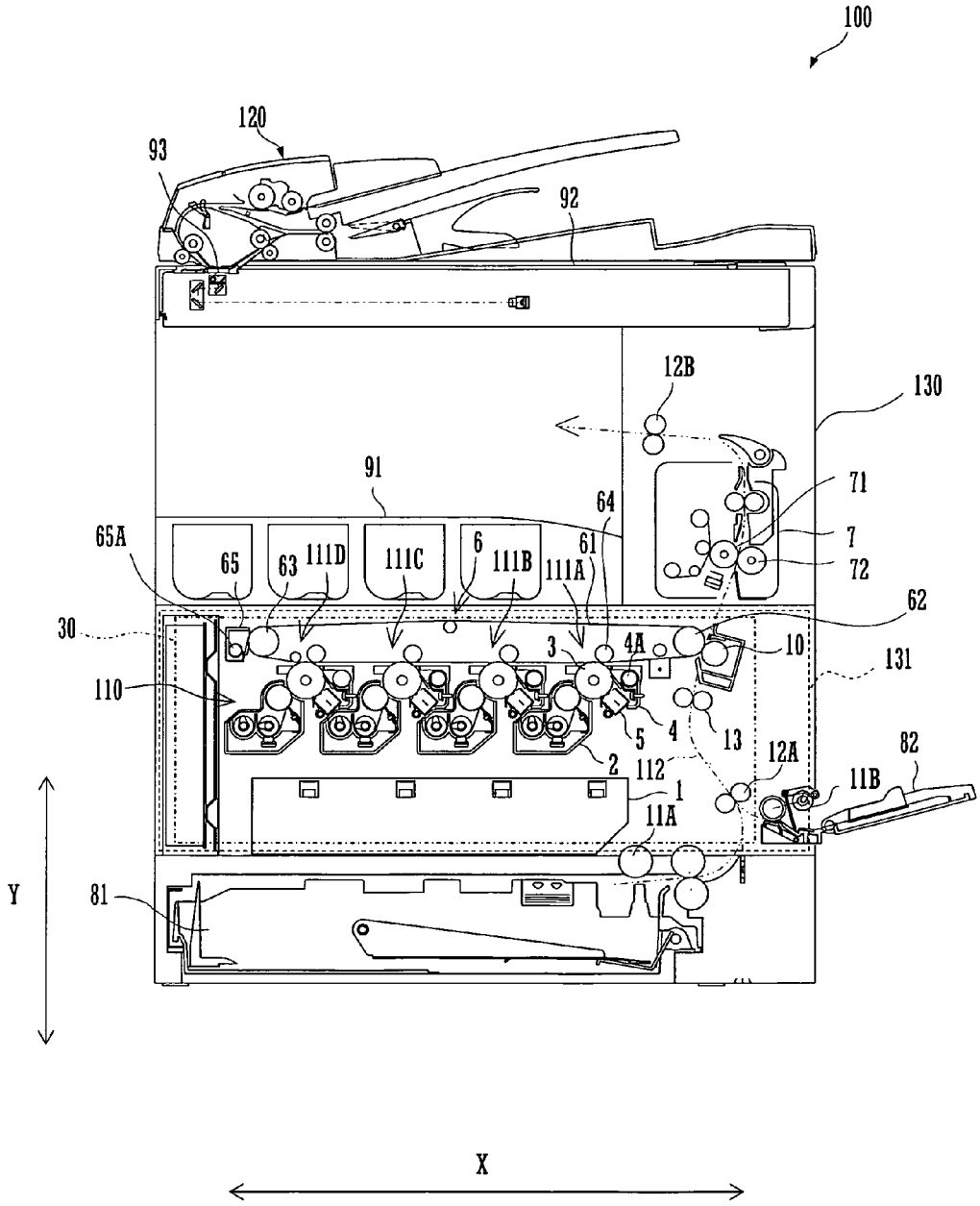
FIG. 1 is a figure showing the overall structure of an image forming device according to an embodiment of the present technology, as seen from the front.

An image forming device which includes a toner recovery unit according to an embodiment of the present technology will now be explained below in detail with reference to the drawings. As shown in FIG. 1, the image forming device which is the main subject of the present technology comprises an image forming unit 110 and a document reading unit 120, and performs multi-color and single color printing processing upon blank a sheet of paper according to image data.

The document reading unit 120 is disposed at the upper portion of the image forming unit 110, and comprises a document tray, platens 92 and 93, and a discharge tray. This document reading unit 120 reads the image of a document which has been mounted upon the platen 92 by manual operation, or of a document which is passing over the platen 93 while being conveyed to the discharge tray from the document tray.

And the image forming unit 110 is placed within a chassis 130, and comprises image forming stations 111A through 111D, an exposure unit 1, an intermediate transfer belt unit 6, a fixing unit 7, a toner recovery unit 30, a position determination unit 40, a paper supply cassette 81, a paper ejection tray 91, and so on. This image forming unit 110 performs printing processing upon a sheet of paper which has been supplied to a paper conveyance path 112 from the paper supply cassette 81.

The image forming stations 111A through 111D respectively correspond to the colors black, cyan, magenta, and yellow. The image forming station 111A comprises a development unit 2, a photoreceptor drum 3, a cleaner 4, and an charging unit 5. The photoreceptor drum 3 has a main body which is an electrically conductive cylinder and a photosensitive layer which is formed over the surface of this main cylindrical body, and rotates in the clockwise direction as seen in FIG. 1. The charging unit 5 is a charger type charging unit, and electrifies the surface of the photoreceptor drum 3 uniformly to a predetermined electrical potential. The development unit 2 supplies black toner to the surface of the photoreceptor drum 3. And the cleaner 4 retrieves waste toner remaining upon the surface of the photoreceptor drum 3, and discharges this waste toner via conduits 4A.

The exposure unit 1 comprises a laser emission unit and a reflecting mirror and so on, and exposes the electrified photoreceptor drum 3 to laser light modulated by black image data, thus creating a latent electrostatic image upon the surface of the photoreceptor drum 3. This latent electrostatic image is developed and appears as a black toner image, due to black toner being supplied from the development unit 2.

The image forming stations 111B through 111D have similar structures to that of the image forming station 111A. In other words, the exposure unit 1 irradiates photoreceptor drums 3 with laser light modulated by image data corresponding to the respective colors cyan, magenta, and yellow so that the image forming stations 111B through 111D can create toner images of the respective colors cyan, magenta, and yellow upon the drums 3.

The intermediate transfer belt unit 6 is disposed above the photoreceptor drums 3, and comprises an intermediate tranfer belt 61, a drive roller 62, a driven roller 63, intermediate transfer rollers 64, and a cleaner unit 65. The intermediate transfer rollers 64 are disposed so that one thereof corresponds to each of the image forming stations 111A through 111D, and the toner images formed by the image forming stations 111A through 111D are transferred onto the intermediate transfer belt 61. And the cleaner unit 65 collects waste toner which remains upon the intermediate transfer belt 61 and discharges this waste toner via a conduit 65A.

The paper supply cassette 81 contains a stack of sheets of paper which is used for image forming, and is installed underneath the exposure unit 1. It is also possible to put sheets of paper to be used for image forming into a manual feed paper supply tray 82.

A paper conveyance path 112 is defined, along which a sheet of paper is conveyed from the paper supply cassette 81 or the manual feed paper supply tray 82 via a transfer roller 10 and the fixing unit 7 to the paper ejection tray 91. The paper ejection tray 91, which is provided above the image forming unit 110, holds paper upon which image forming processing has been performed by the image forming unit 110. Pickup rollers 11A and 11B, a pair of conveyance rollers 12A, a pair of resist rollers 13, the transfer roller 10, the fixing unit 7, and a pair of conveyance rollers 12B are arranged in that order along the paper conveyance path 112 from its upstream end to its downstream end, i.e. in the direction in which paper is conveyed therealong.

The pickup rollers 11A are provided near the end portion of the paper supply cassette 81, and pick up one sheet of paper at a time from the paper supply cassette 81 and convey it along the paper conveyance path 112. And the pickup rollers 11B are provided near the end portion of the manual feed paper supply tray 82, and pick up one sheet of paper at a time from the manual feed paper supply tray 82 and convey it along the paper conveyance path 112.

After temporarily holding a sheet of paper, the resist rollers 13 convey it at such a timing that the leading edge of the paper sheet comes to meet the line of contact between the transfer roller and the intermediate transfer belt 6, just at the leading edge of the toner image upon the intermediate transfer belt 6.

And the transfer roller 10 transfers the toner image which is being carried upon the intermediate transfer belt 6 onto the printing surface of the paper sheet.

The fixing unit 7 is located above the transfer roller 10 and includes a heating roller 71 and a pressurization roller 72, and applies heat and pressure to the sheet of paper upon which the toner image has been transferred, thus fixing the toner image upon the surface of the paper sheet.

The chassis 130 has a front panel 131 which covers over the toner recovery unit 30. This front panel 131 is the "facing member" of the Claims, and is supported by base points at both ends of its lower edge, so as to be able to open forwards and to close. The front panel 131 can be moved between a shielding position in which it covers over the toner recovery unit 30 (when the toner recovery unit 30 is installed), and an opened position in which it does not cover over the toner recovery unit 30. Due to this, it is possible to open the front panel 131 and fit or remove the toner recovery unit 30 to or from the image forming unit 110. It should be understood that it may also be arranged to support the front panel 131 by points upon one of its edges which extends vertically, so that it can open forwards or close.

Figure 2:
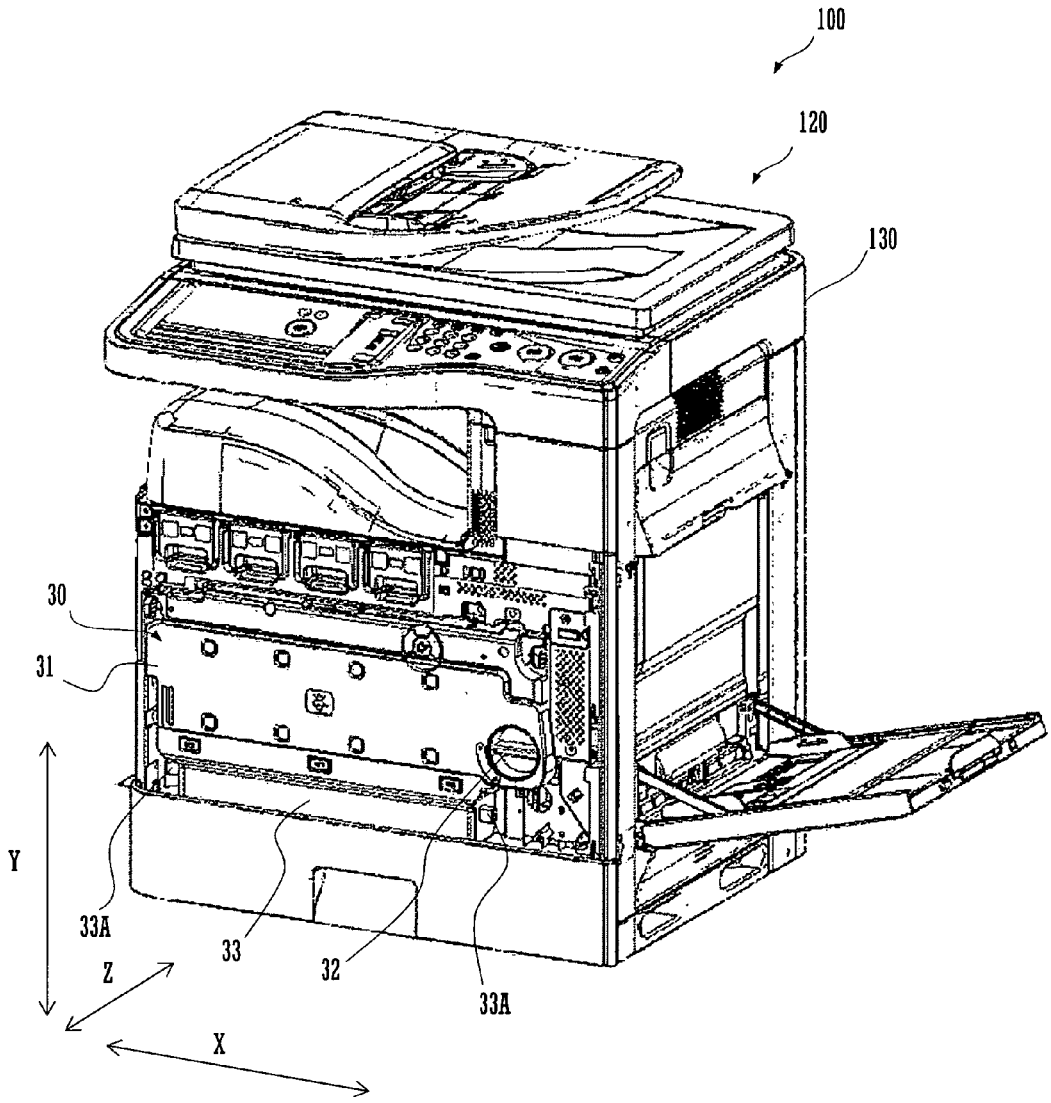
FIG. 2 is a perspective view showing the overall structure of this image forming device, in its state with a front panel removed.
Figure 3:
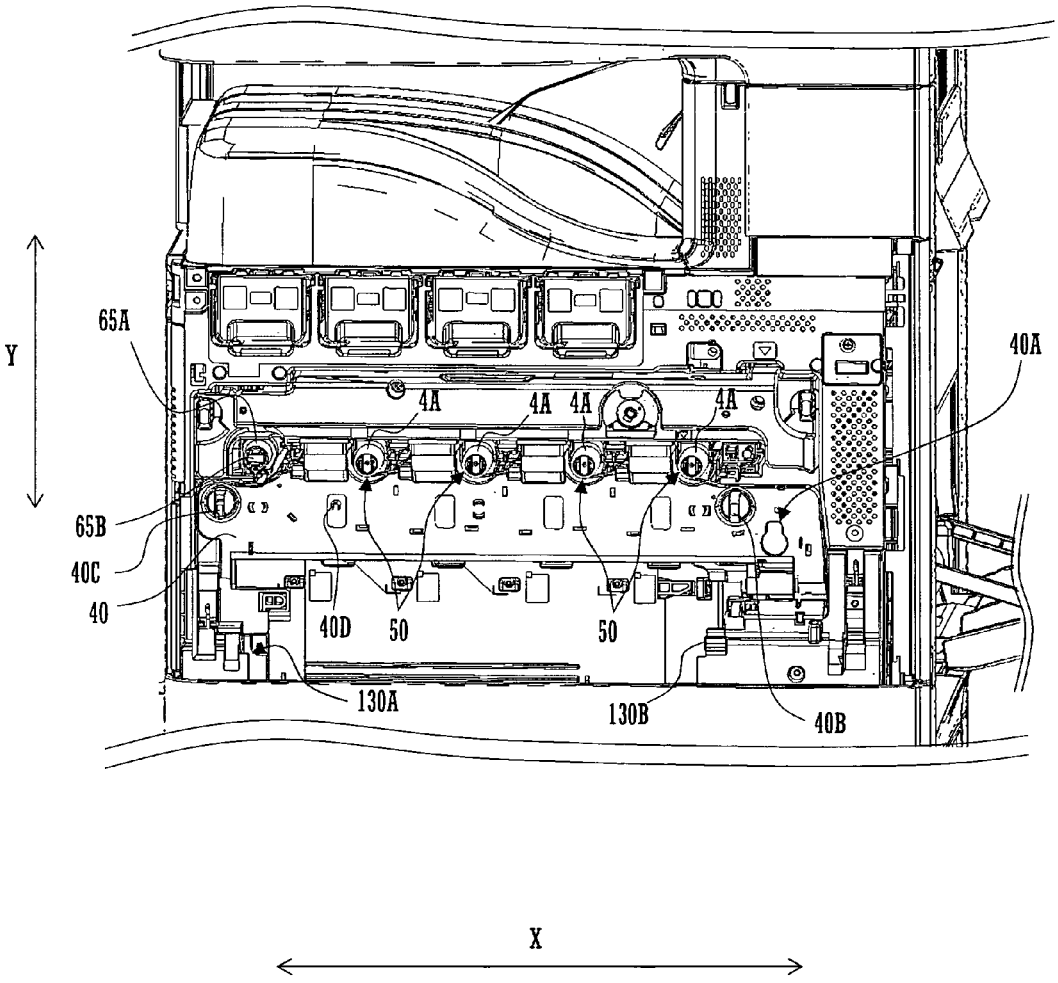
FIG. 3 is a figure showing a toner recovery unit in a state in which it has been removed from a position determination unit.

FIG. 2 is a perspective view showing the overall structure of this image forming device 100 in its state with the front panel 131 removed. And FIG. 3 is an enlarged view showing the toner removal unit 30 in its state as taken off from the position determination unit 40.

Opening/closing members 50 are rotatably inserted into the front ends of the conduits 4A, and can change over the conduits 4A between the opened state and the closed state. And an opening/closing members 65B is rotatably inserted into the front end of a conduit 65A, and changes over a discharge outlet in which the conduit 65A is provided between the closed state and the opened state. In the state in which the toner recovery unit has been removed, the opening/closing members 50 and the opening/closing member 65B are positioned in their closed positions which keep the conduits 4A and the conduit 65A in their closed states. The opening/closing members 50 and 65B correspond to the second opening/closing members of the Claims. If it is not necessary to change over the conduits 4A and 65A between their opened and closed states, then it would be acceptable to omit the opening/closing members 50 and 65B.

The position determination unit 40 is supported, so as to be rotatable forwards, by base points at both ends of its lower edge in the longitudinally direction, in front of the exposure unit 1, the development unit 2, the photoreceptor drums 3, the cleaner unit 4, the charging unit 5, and the intermediate transfer belt cleaning unit 65. An engagement aperture 40A, a fixing knob 40B a fixing knob (engagement portion) 40C, and projecting portions 40D are provided upon this position determination unit 40. The engagement aperture 40A and the fixing knobs 40B and 40C are engagement members which are fixed to the front surface of the toner recovery unit 30 and positionally determine it.

Figure 4:
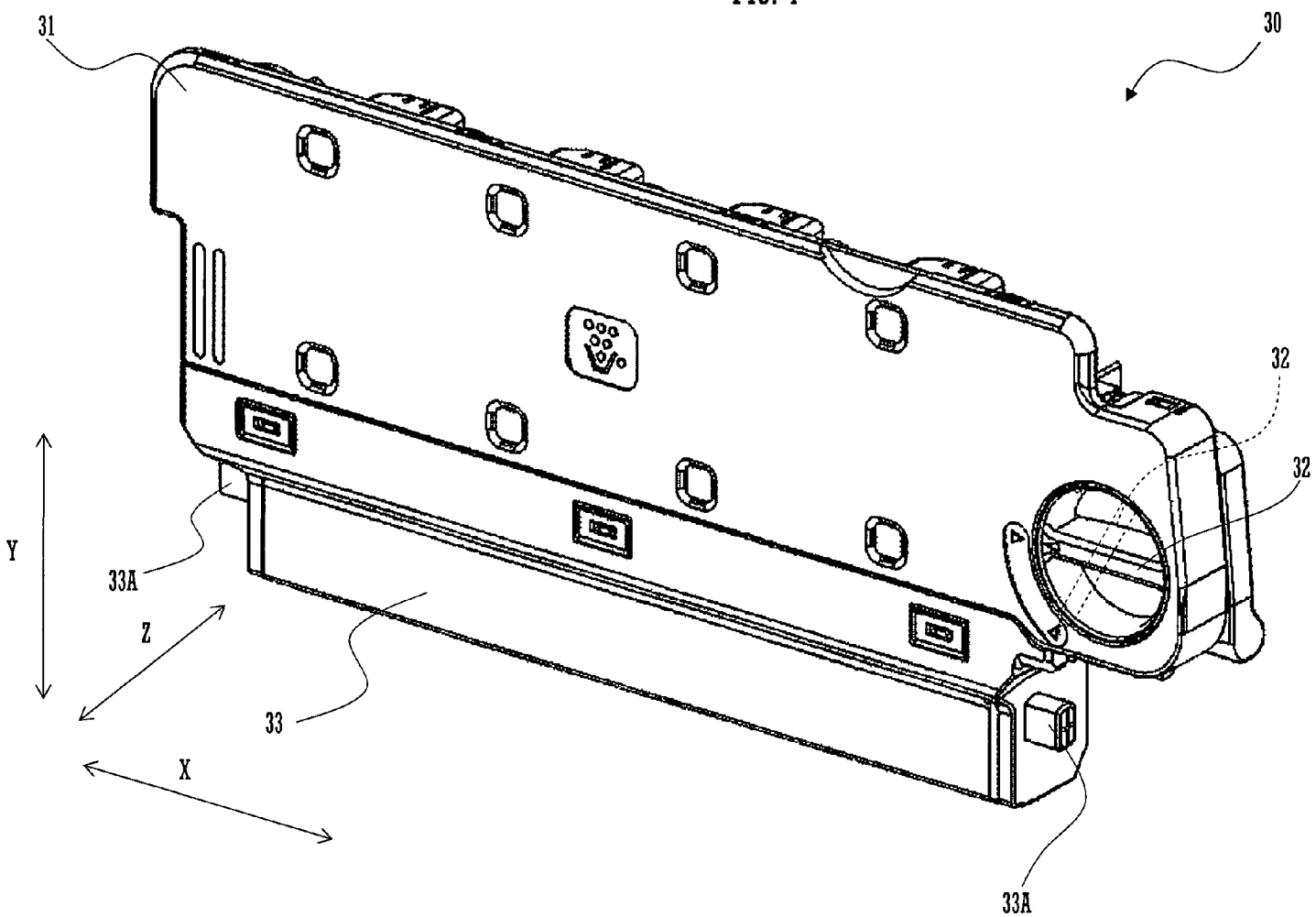
FIG. 4 is a perspective view showing the structure of the front of the toner recovery unit.
Figure 5:
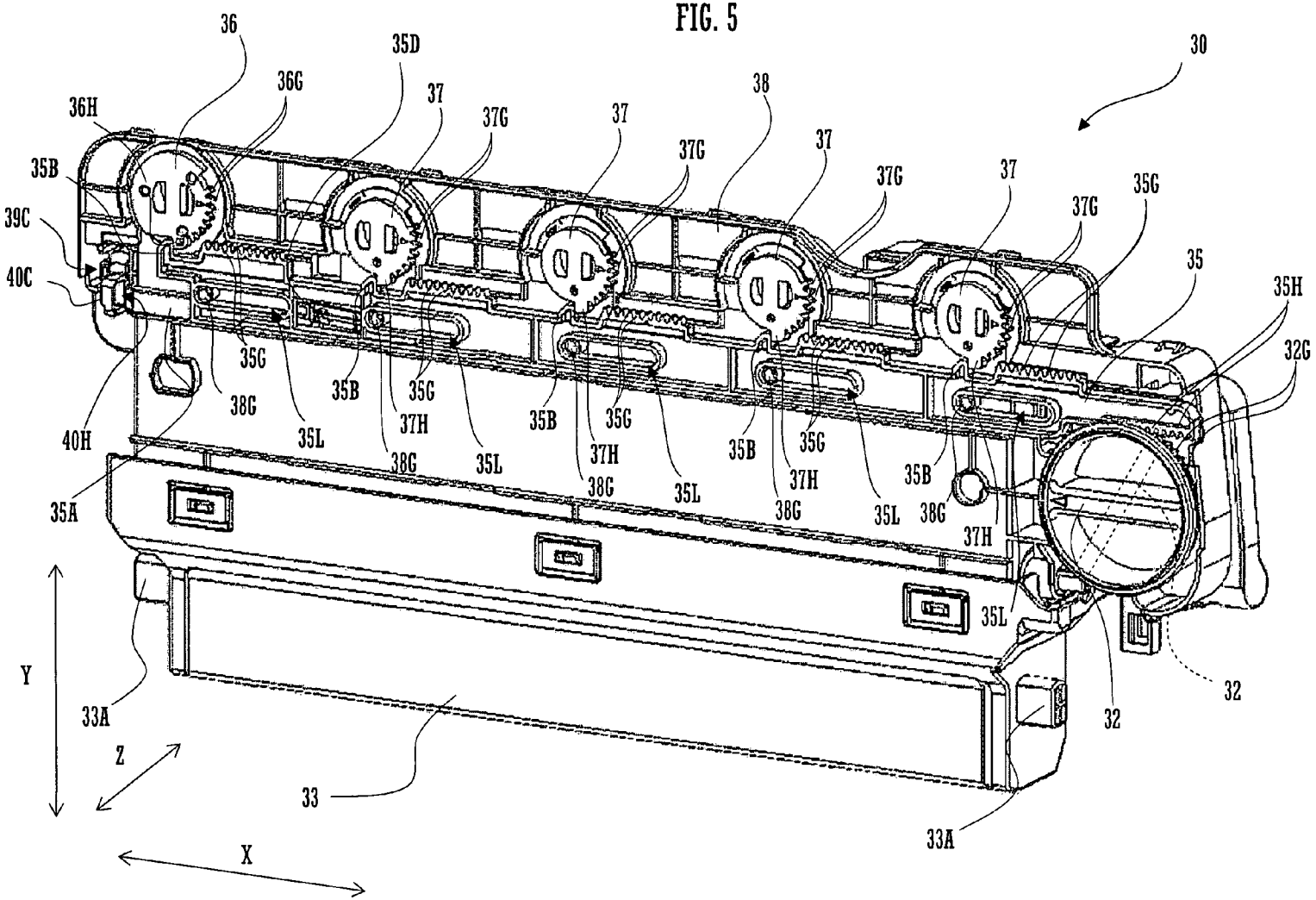
FIG. 5 is a perspective view showing the structure of the interior of the front of the toner recovery unit.
Figure 6:
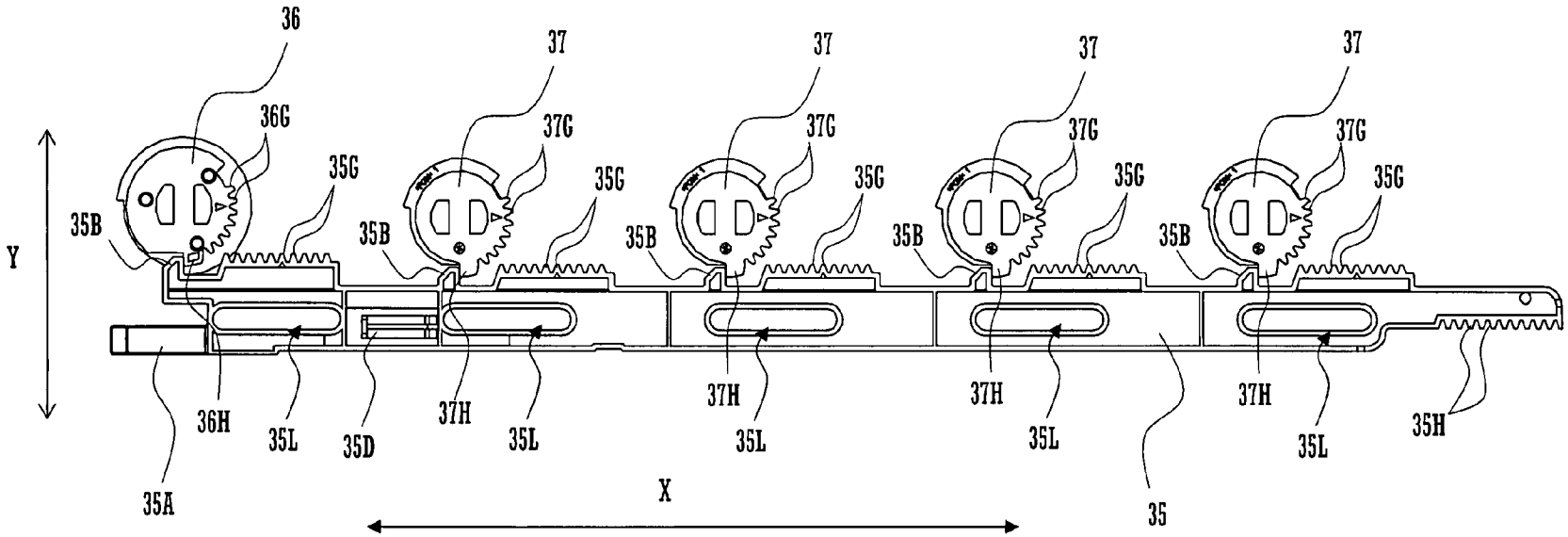
FIG. 6 is a figure showing the structure around a shift member when an operating unit is positioned in a first operating position.
Figure 7:
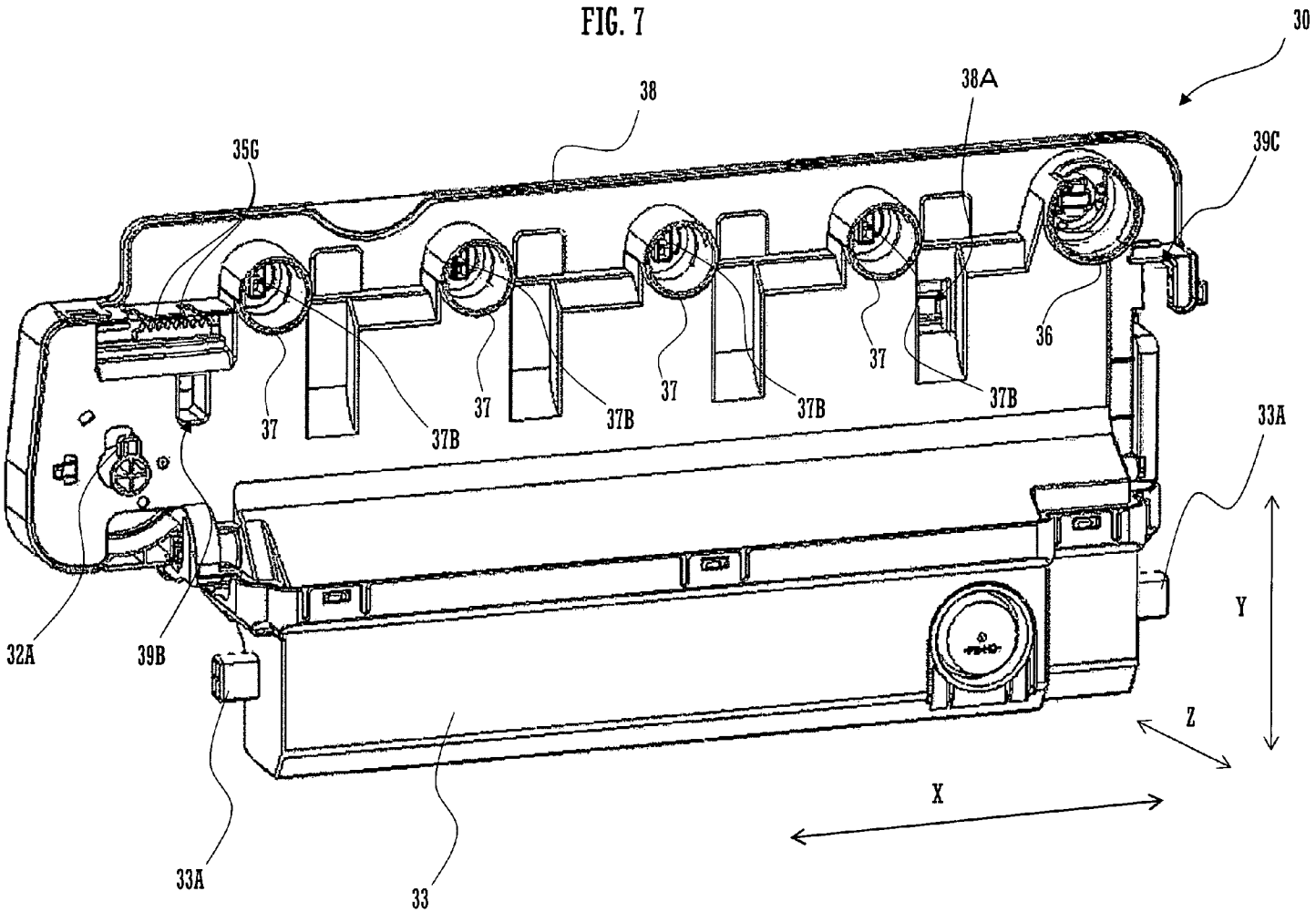
FIG. 7 is a perspective view showing the structure of the rear of the toner removal unit.

FIG. 4 is a perspective view showing the toner recovery unit 30 as seen from its front. FIG. 5 is a perspective view showing the internal structure of the front of the toner recovery unit 30. FIG. 6 is a figure showing the structures around a shift member 35 shown in FIG. 5. And FIG. 7 is a perspective view showing the toner recovery unit 30 as seen from its rear.

The toner recovery unit 30 comprises a cover 31, an operating member 32, a waste toner storage tank 33, the shift member 35, opening/closing members (first opening/closing members) 36 and 37, and a frame 38, and is installed to the position determination unit 40 so as to be freely fittable and removable.

The operating member 32 is fitted to the front surface of the frame 38 in a freely rotatable manner. The shift member 35 is fitted to the front surface of the frame 38 so as to shift freely along the direction shown by the arrows X. The waste toner storage tank 33 is fitted to the lower portion of the frame 38. And engagement portions 39B and 39C are provided at both ends of the rear surface of the frame 38 along the direction of the arrows X.

When the toner recovery unit 30 is fitted to the position determination unit 40, the engagement portions 39B and 39C are respectively engaged to the fixing knobs 40B and 40C from the front, and thereby the toner recovery unit 30 is installed in its predetermined installation position, with the conduits 4A and the conduit 65A being connected to the opening/closing members 37 and to the opening/closing member 36. Due to this, it is possible to support the toner recovery unit 30 upon the position determination unit 40 in the state in which conduits 4A and the conduit 65A are respectively connected to the opening/closing members 37 and to the opening/closing member 36. It should be understood that while, in this embodiment, the toner recovery unit 30 is provided with a total of five of the opening/closing members, any plural number of such opening/closing members will be acceptable.

Figure 8:
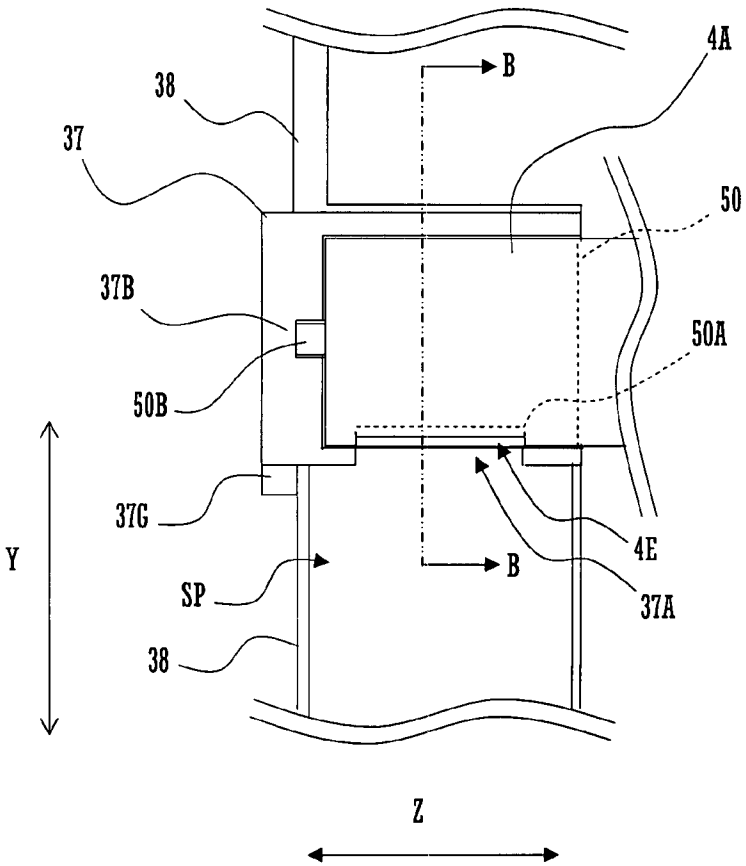
FIG. 8(A) is a figure showing the structure around an opening/closing member in the state in which the operating unit is rotated to its first operating position.
FIG. 8(B) is a figure showing the structure around this opening/closing member in the state in which the operating unit is rotated to a second operating position.
Figure 8:
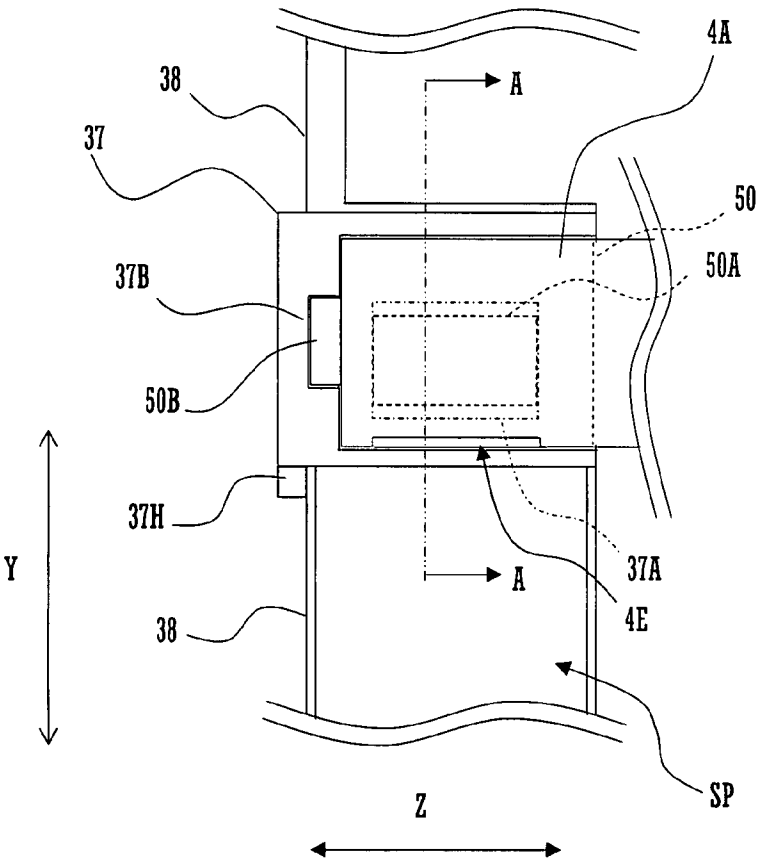
Figure 9:
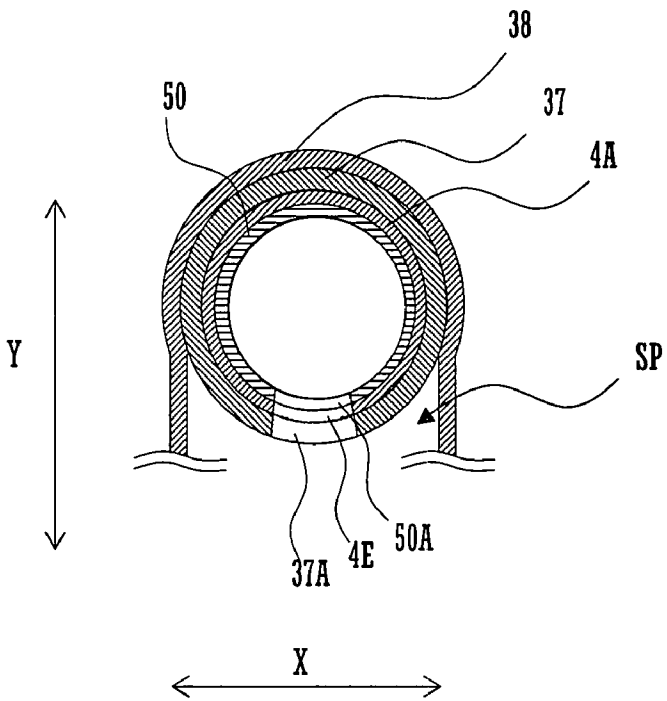
FIG. 9(A) is a sectional view taken in a plane shown by the arrows A-A in FIG. 8(A)
FIG. 9(B) is a sectional view taken in a plane shown by the arrows B-B in FIG. 8(B)
Figure 9:
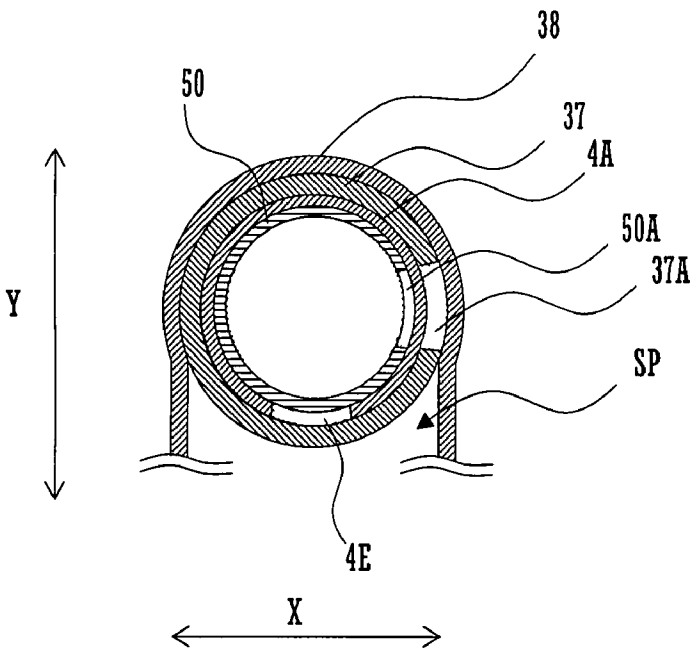
Figure 10:
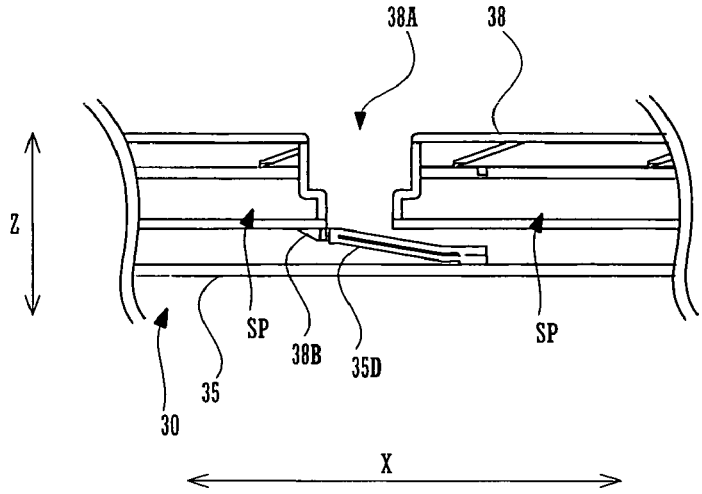
FIG. 10(A) is a figure showing the structure around a regulation member 35 when, in the state in which the toner recovery unit is not fitted to the position determination unit, the operating unit is positioned in its first operating position.
FIG. 10(B) is a figure showing the state in which, from the state shown in FIG. 10(A), the toner recovery unit has been fitted to the position determination unit.
Figure 10:
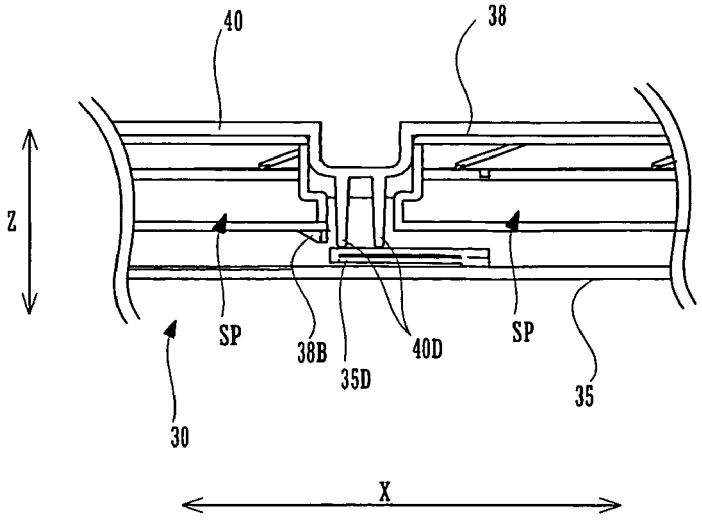

A discharge passage SP shown in FIGS. 8 through 10 is formed in the frame 38. This discharge passage SP is a gap which communicates the opening/closing members 36 and 37 with the waste toner storage tank 33, and is formed over almost the entire width of the frame 38, from the positions at which the opening/closing member 36 and the opening/closing members 37 are disposed, to the waste toner storage tank 33. Toner which is discharged from the opening/closing member 36 and the opening/closing members 37 passes along this discharge passage SP and falls down within the waste toner storage tank 33.

The opening/closing member 36 passes through the discharge passage SP formed in the frame 38, from its front in a position above the neighborhood of the engagement portion 39C to its rear, and is rotatably supported thereby. And this opening/closing member 36 is rotatably supported between an opening position in which it communicates the conduit 65A with the discharge passage SP, and a closed position in which it intercepts such communication.

And four of the opening/closing members 37 are provided along the longitudinal direction, from a position which is adjacent to the opening/closing member 36. Each of these opening/closing members 37 is rotatably supported upon the frame 38, and passes through the discharge passage SP, in a similar manner to the opening/closing member 36. And the opening/closing members 36 are rotatably supported between opening positions in which they communicate the conduits 4A with the discharge passage SP, and closed positions in which they intercept such communication.

The waste toner storage tank 33 is a storage unit which stores toner discharged via the opening/closing member 36 and the opening/closing members 37. Projecting portions 33A are provided at both ends of the waste toner storage tank 33 in the longitudinal direction. And engagement portions 130A and 130B are disposed at both its ends, under the front of the position determination unit 40. Arc shaped hollows which engage the projecting portions 33A are provided upon the upper surfaces of these engagement portions 130A and 130B. Due to this, when the toner recovery unit 30 is fitted to the position determination unit 40, it is possible to support its lower edge portion upon the engagement portions 130A and 130B. It should be understood that the engagement portions 130A and 130B are omitted from FIG. 2.

By providing the projection portions 33A at both ends of the waste toner storage tank 33, it is possible to obtain the beneficial effect that, when the toner recovery unit 30 is to be removed from the position determination unit 40 and taken away, the operator may simply grip the toner recovery unit 30. Furthermore, in this embodiment, one of the projecting portions 33A is disposed nearly directly underneath the operating member 32. Due to this, after the operator has fitted the toner recovery unit 30 to the position determination unit while gripping the projecting portions 33A, it is then possible for him immediately to rotationally actuate the operating member 32 which is disposed directly over that one of the projecting portions 33A. As a result, the advantageous effect is also obtained that it is possible to perform the task of fitting the toner recovery unit 30 more smoothly.

Although in this embodiment, by way of example, a case is discussed in which the projecting portions 33A are provided upon the toner recovery unit 30, it would also be acceptable not to provide these projecting portions 33A, depending upon the specification of the toner recovery unit 30. Moreover, it would also be acceptable only to provide one of the projecting portions 33A.

The operating member 32 is a cylindrical operating knob which is supported by the frame 38, and which is rotatable between a first operating position shown by the solid lines and a second operating position shown by the broken lines (refer to FIGS. 4 and 5). This operating member 32 is arranged so as to pass through the frame 38 from its front to its rear. And an engagement portion 32A (see FIG. 7) is provided at the rear end of the operating member 32, so as to project to within the X-Y plane.

When the toner recovery unit 30 is installed to the position determination unit 40, the engagement portion 32A fits removably into the engagement aperture 40A in the Z direction, and moreover engages with the engagement aperture 40A when the operating member 32 is rotationally actuated from its first operating position to its second operating position. Due to this, it is possible to prevent the toner recovery unit 30 from falling off.

The shift member 35 is disposed directly underneath the opening/closing members 36 and 37, and shifts along the X direction along with rotational operation of the operating member 32. In the state in which the operating member 32 is positioned in its first operating position as shown in FIG. 5, the shift member 35 is positioned at an engagement release position in which its end portion 35A does not engage with the fixing knob 40C. On the other hand, when the operating member 32 is rotated to its second operating position shown by the broken line in FIG. 5, the shift member 35 shifts along the X direction to an engagement position in which its end portion 35A engages with an engagement aperture 40H of the fixing knob 40C. Moreover, the shift member 35 is provided with a regulation member 35D which is positioned near its end portion 35A. In the frame 38, at a position which faces the regulation member 35D when the operating member 32 is positioned in its first operating position, there is provided a through hole 38A which passes through the discharge passage SP. Racks (driving portions) 35G, 35G, . . . are provided along the upper surface of the shift member 35 along its longitudinal direction, so as to correspond to each of the opening/closing members 36 and 37. On the other hand, at the edges of the opening/closing members 36 and 37, gears (driven portions) 37G, 37G, . . . are provided which can be engaged with, and disengaged from, the corresponding ones of these racks 35G.

Each of the racks 35G is provided in a position in which, in the state in which the end portion 35A of the shift member 35 is not engaged with the engagement aperture 40H which is provided to the fixing knob 40C, it does not mesh with its corresponding one of the gears 36G and 37G. However after, along with the shifting of the shift member 35 from its engagement release position towards the fixing knob 40C, its end portion 35A has shifted to its engagement position in which it engages with the fixing knob 40C, also, due to the shift member 35 having shifted towards the fixing knob 40C, the racks 35G become meshed with the gears 35G and 37G. The racks 35G which have thus meshed with the gears 36G and 37G cause the opening/closing members 36 and 37 to rotate from their closed positions to their opened positions. Due to this, it is possible to perform the operation of fixing the toner recovery unit 30 to the position determination unit 40, and the operation of opening and closing the opening/closing members 36 and 37 by shifting the shift member 35, together as a single smooth operation.

In this manner after, along with the shifting of the shift member 35 towards the fixing knob 40C, its end portion 35A has engaged with and become fixed to the fixing knob 40C, it is possible to cause the opening/closing members 36 and 37 to rotate from their closed positions to their opened positions. Due to this, since, even though the shift member 35 is biased and bent by the opening/closing members 36 and 37, the shift member 35 is already engaged with the fixing knob 40C, accordingly it is possible to cause the opening/closing members 36 and 37 to rotate as far as their opened positions, while the mutually engaged state of the shift member 35 and the fixing knob 40C is maintained.

It should be understood that although, in this embodiment, a case has been discussed by way of example in which the operation of fixing the toner recovery unit 30 to the position determination unit 40, and the opening and closing operation of the opening/closing members 36 and 37, are performed together with the shifting operation of the shift member 35, the present technology is not to be considered as being limited by this detail. For example, it would also be acceptable to arrange for the above described operation of fixing the toner recovery unit 30 to be performed separately, and for only the opening and closing operation of the opening/closing members 36 and 37 to be performed together with the shifting operation of the shift member 35.

In this embodiment, a case has been discussed by way of example in which the shift member 35 causes the opening/closing members 36 and 37 to be rotated from their closed positions to their opened positions, after the shift member 35 has been engaged to the engagement aperture 40H along with shifting towards the fixing knob 40C. However, the present technology is not to be considered as being limited by this detail. For example, it would also be acceptable to provide a structure with which it is possible for the end portion 35A to engage smoothly with the engagement aperture 40H at a deflection of the shift member 35 which is not large enough for the opening/closing members 36 and 37 to be rotated from their closed positions to their opened positions, and with which the shift member 35 is engaged with the engagement aperture 40H while rotating the opening/closing members 36 and 37 from their closed positions to their opened positions. Furthermore, it would also be possible to arrange for the shift member 35 to engage to the engagement aperture 40H, after the opening/closing members 36 and 37 have been rotated from their closed positions to their opened positions.

Moreover, contacting projections 35B are provided near the ends of the racks 35G towards the engagement portion 39C, with certain gaps therebetween. Here, these certain gaps are set to values such that, along with rotation of the operating member 32 from its second operating position towards its first operating position, the contacting projections 35B contact against their corresponding engagement portions 36H and 37H when the racks 35G have meshed with their corresponding gears 36G and 37G, and, when the shift member 35 is shifted as far as its engagement release position, it biases the opening/closing members 36 and 37 to their closed positions. Due to this, along with shifting of the operating member 32 from its second operating position to its first operating position, it is possible for the opening/closing members 36 and 37 to be rotated by the shift member 35 from their opened positions to their closed positions. It should be understood that while, in this embodiment, an example has been discussed in which the shift member 35 rotationally drives the opening/closing members 36 and 37 by way of gearing, it would also be acceptable for the shift member 35 to rotationally drive the opening/closing members 36 and 37 with slide members which slide against them.

At its other end portion from its end portion 35A, the shift member 35 is provided with a rack 35H along its lower edge. A gear 32G is provided on the circumference of the operating member 32, and is meshed with this rack 35H. Due to this, it is possible for the shift member 35 to be shifted along the X direction when the operating member is rotated between its first operating position and its second operating position. It should be understood that while, in this embodiment, an example has been explained in which the shift member 35 is shifted in the X direction due to rotational operation of the operating member 32, alternatively, it would also be acceptable to arrange to bias the shift member 35 in the X direction directly without using any operating member 32.

Moreover, in this embodiment, the operating member 32 and the opening/closing members 36 and 37 are arranged so that they lie on opposite sides of the shift member 35 in the Y direction, which is orthogonal to the X direction which is the direction of shifting of the shift member 35. Due to this, even though the shift member 35 is biased upwards by the rotational operation of the operating member 32, still it is possible to shift the shift member 35 along the X direction in a smooth manner, while its shifting upwards is regulated by the opening/closing members 36 and 37.

Although, in this embodiment, the shift member 35 is engaged with the fixing knob 40C by the end portion 35A of the shift member being engaged with the fixing knob 40C, it would also be acceptable, for example, to provide a structure in which this end portion 35A and the shift member 35 are constituted as separate members.

It should be understood that the shift member 35 is arranged at the front side of the frame 38, which is its opposite side to its side in which the discharge passage SP is formed.

Due to this, the advantageous effect is obtained that it is possible to prevent toner which is passing through the discharge passage SP from adhering to the shift member 35, so that it is possible to prevent the smooth meshing between the racks 35G and the gears 36G and 37G from being deteriorated by toner which has adhered to the shift member 35.

In this embodiment a case has been explained, by way of example, in which the shift member 35 is supported so as to be shiftable along the X direction by the front surface of the frame 38, and is shielded by the discharge passage SP. However, the present technology is not to be considered as being limited by this feature. For example, it would also be acceptable to provide an arrangement in which the shift member 35 is positioned so as to pass within the discharge passage SP, provided that it is possible to perform the operation of opening and closing the opening/closing members 36 and 37 with the shift member 35 in a smooth manner.

Here, five projecting portions 38G are provided to the frame 38 along the longitudinal direction of the frame 38, and are shaped as cylindrical pillars which protrude in the forward direction from positions upon the frame 38 directly below the opening/closing members 36 and 37, opposing the shift member 35. On the other hand, elongated grooves 35L are provided upon the shift member 35, with the projecting portions 38G below the racks 35G being engaged into these grooves 35L so that the shift member 35 is able to shift freely along the X direction. The lengths in the X direction of these elongated grooves 35L are set so as to be greater than or equal to the distance through which the shift member 35 shifts in the X direction when the operating member 32 is actuated from its first operating position to its second operating position. And the lengths in the Y direction of these elongated grooves 35L are set to be a little longer than the diameters of the projecting portions 38G.

Due to this, when the racks 35G are meshed with the gears 36G and 37G, it is possible to prevent the racks 35G from being biased by the opening/closing members 36 and 37 so as to be shifted downwards. Because of this, it is possible to obtain the advantageous effect of preventing the meshing engagement between the racks 35G and the gears 36G and 37G from becoming separated.

In this embodiment, by way of example, a case was explained in which the elongated grooves 35L of the shift member 35 were provided directly below each of the opening/closing members 36 and 37, with the projecting portions 38G being engaged into the corresponding ones of these elongated grooves 35L. However, the present technology is not to be considered as being limited by this feature. For example, provided that a sufficient beneficial effect for preventing the shifting of the shift member 35 downwards can be obtained, it would also be acceptable to arrange to provide the elongated grooves 35L and the projecting portions 38G directly below that opening/closing member 37, among the opening/closing members 36 and 37, which is positioned in the center of the frame 38 in the longitudinal direction.

The cover 31 covers over the entire surface of the toner recovery unit 30 so as to seal it, except for the waste toner storage tank 33 and the operating member 32 at the front of the toner recovery unit 30. Due to this, it is possible to prevent toner from escaping from around the opening/closing members 36 and 37 to the exterior, in a more reliable manner. It should be understood that while, in this embodiment, the user of a cover 31 is described by way of example, this is not limitative of the present technology; depending upon the specification of the toner recovery unit 30, it would also be acceptable not to use any cover 31.

FIG. 8(A) is a figure showing the structure around one of the opening/closing members 37 and one of the opening/closing members 50 when, in the state with the toner recovery unit 30 installed to the position determination unit 40, the operating member 32 is positioned in its first operating position. And FIG. 8(B) is a figure showing the structure around one of the opening/closing members 37 and one of the opening/closing members 50 when, in the state with the toner recovery unit 30 installed to the position determination unit 40, the operating member 32 is positioned in its second operating position. The shift member 35 is not shown in FIGS. 8(A) and 8(B). Moreover, FIG. 9(A) is a figure showing a cross section taken in a plane indicated by the arrows A-A in FIG. 8(A). And FIG. 9(B) is a figure showing a cross section taken in a plane indicated by the arrows B-B in FIG. 8(B). Here, the structure around the opening/closing member 36 and the opening/closing member 65B is omitted, since it is almost identical to the structures around the opening/closing members 37 and the opening/closing members 50.

A discharge outlet 4E is provided at the lower portion of the circumferential surface of the conduit 4A. The opening/closing member 37 is provided with an opening portion 37A shown by the single dotted broken line on its circumferential surface which, in the state in which the toner recovery unit 30 is installed to the position determination unit 40, is positioned coaxially with the discharge outlet 4E.

Along with the opening/closing member 50 being provided on its circumferential surface with an opening portion 50A shown by the broken line in FIG. 9(A) which, in the state in which the toner recovery unit 30 is installed to the position determination unit 40, is coaxially over the discharge outlet 4E, it is also provided, on its front portion which is formed as circular, with a projecting portion 50B made as a rectangular parallelepiped. On the other hand, in a position on the opening/closing member 37 which faces the projecting portion 50B, there is provided a receiving portion 37B into which the projecting portion 50B fits. This receiving portion 37B and projecting portion 50B are made so as to be insertable and removable into and from one another in the Z direction, only in the state in which the opening/closing member 37 and the opening/closing member 50 are both arranged in their opening position or are both arranged in their closing position. Due to this, it is possible to install the toner recovery unit 30 to the position determination unit 40, only when the opened or closed state of the opening/closing member 37 and the open or closed state of the opening/closing member 50 agree with one another. Furthermore, it is possible to perform the opening or closing operation of the opening/closing member 50 and the opening or closing operation of the opening/closing member 37 together.

In the closed position of the opening/closing members 37 and 50 in which, as shown in FIG. 8(A), the longitudinal direction of the projecting portion 50B lies parallel with the Y direction, the opening portions 37A and 50A do not face towards the discharge outlet 4E and the discharge passage SP, but are positioned towards the fixing knob 40B. Due to this, it is possible to maintain the state in which both the discharge outlet 4E and the discharge passage SP are shielded, and the conduit 4A is not communicated with the discharge passage SP. On the other hand, in the opened position of the opening/closing members 37 and 50 in which, as shown in FIG. 8(B), the longitudinal direction of the projecting portion 50B lies parallel with the X direction, the opening portions 37A and 50A rotate downwards so that they face the discharge outlet 4E. Due to this, it is possible to open the discharge outlet 4E, and to communicate the conduit 4A with the discharge passage SP.

FIG. 10(A) is a figure showing, in the state in which the toner recovery unit 30 is not fitted to the position determination unit 40, the structure around the regulation member 35D in the X-Z plane when the operating member 32 is positioned to its first operating position. And FIG. 10(B) is a figure showing the state in which, from the state shown in FIG. 10(A), the toner recovery unit 30 has been fitted to the position determination unit 40.

The regulation member 35D is a plate shaped member provided to the shift member 35, which projects towards the frame 38. As shown in FIG. 10(A), in the state in which the operating member 32 is positioned to its first operating position, this regulation member 35D is engaged with an engagement portion 38B which is provided to the frame 38. Due to this it is possible to prevent the shift member 35 from shifting in the X direction in the state in which the toner recovery unit 30 is not installed to the position determination unit 40. Because of this, when the toner recovery unit 30 is taken off from the position determination unit 40, it is possible to keep all of the opening/closing members 36 and 37 in their closed positions. As a result, when the toner recovery unit 30 is taken off from the position determination unit 40, it is possible to prevent the opening/closing member 36 and the opening/closing members 37 from rotating from their closed positions to their opened positions, which would result in the toner stored in the waste storage tank 33 spilling out.

On the other hand, in the state in which the toner recovery unit 30 is installed to the position determination unit 40, the regulation member 35D is biased forward by projecting portions 40D of the position determination unit 40 which project forward through the through hole 38A, to a position in which it does not engage with the engagement portion 38B. Due to this, it is possible to release the engagement between the engagement portion 38D and the regulation member 35D along with the toner recovery unit 30 being fitted to the position determination unit 40. And, due to this, along with the operation of installing the toner recovery unit 30 to the position determination unit 40, it is possible to release the engagement between the shift member 35 and the frame 38.

The operation of fixing the toner recovery unit 30 when the operating member 32 is rotationally actuated in the state in which the toner recovery unit 30 is installed to the position determination unit 40 will now be explained below.

When the operating member 32 is rotated from its first operating position to its second operating position in the state in which the toner recovery unit 30 is installed to the position determination unit 40, along with the engagement portion 32A being engaged to the engagement aperture 40A, the end portion 35A is engaged to the fixing knob 40C. Due to this, it is possible to fix the toner recovery unit 30 to the position determination unit 40. Moreover, when the operating member 32 is rotated from its second operating position to its first operating position, along with the engagement between the engagement portion 32A and the engagement aperture 40A being released, the engagement between the fixing knob 40C and the end portion 35A is also released. Due to this, it is possible to take the toner recovery unit 30 off from the position determination unit 40.

As a result, it is possible to prevent the toner recovery unit 30 from being taken off from the position determination unit 40, in the state in which the operating member 32 is rotated to its second operating position.

It should be understood that although, in this embodiment, the regulation member 35D is provided to the shift member 35, it would also be acceptable not to provide any such regulation member 35D, if it is acceptable for the shift member 35 to shift in the state in which the toner recovery unit 30 is not installed to the position determination unit 40.

Figure 11:
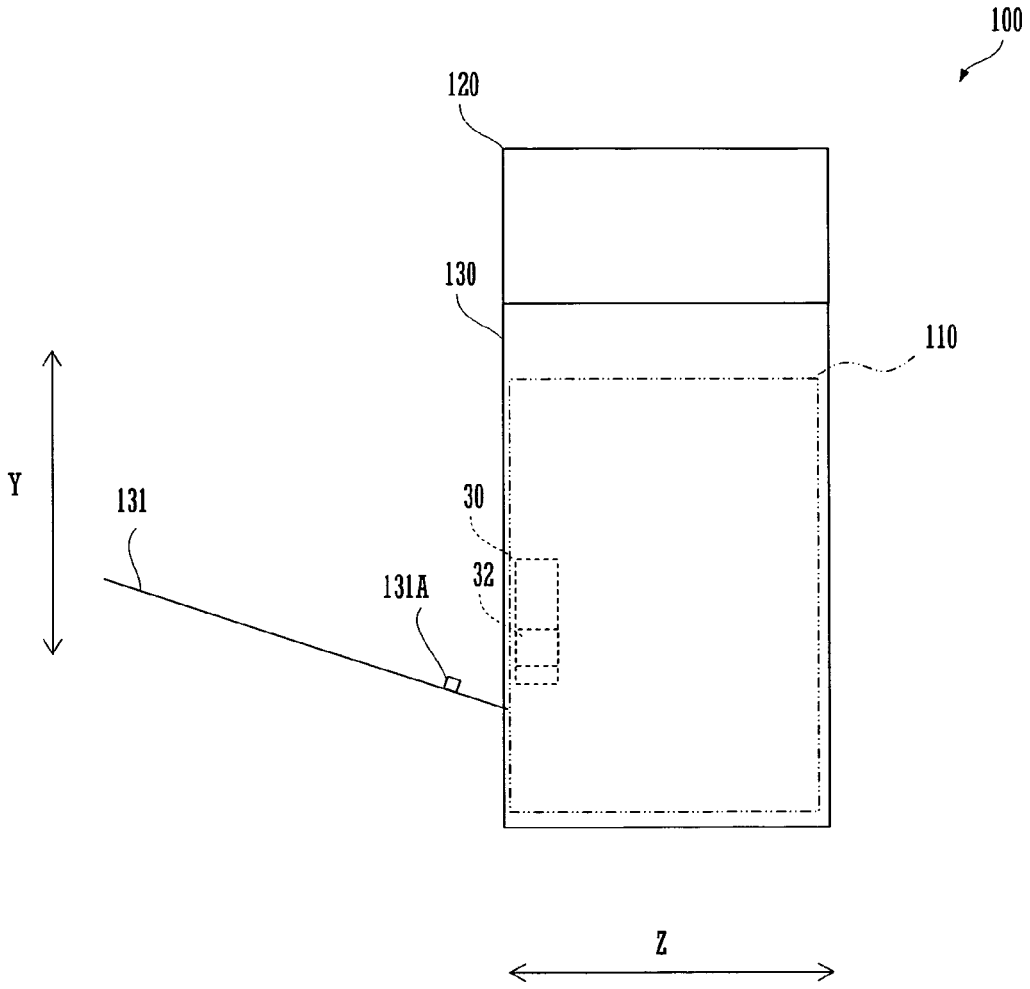
FIG. 11 is a figure showing a side view of the structure of the image forming device, in its state when its front panel has been opened.
Figure 12:
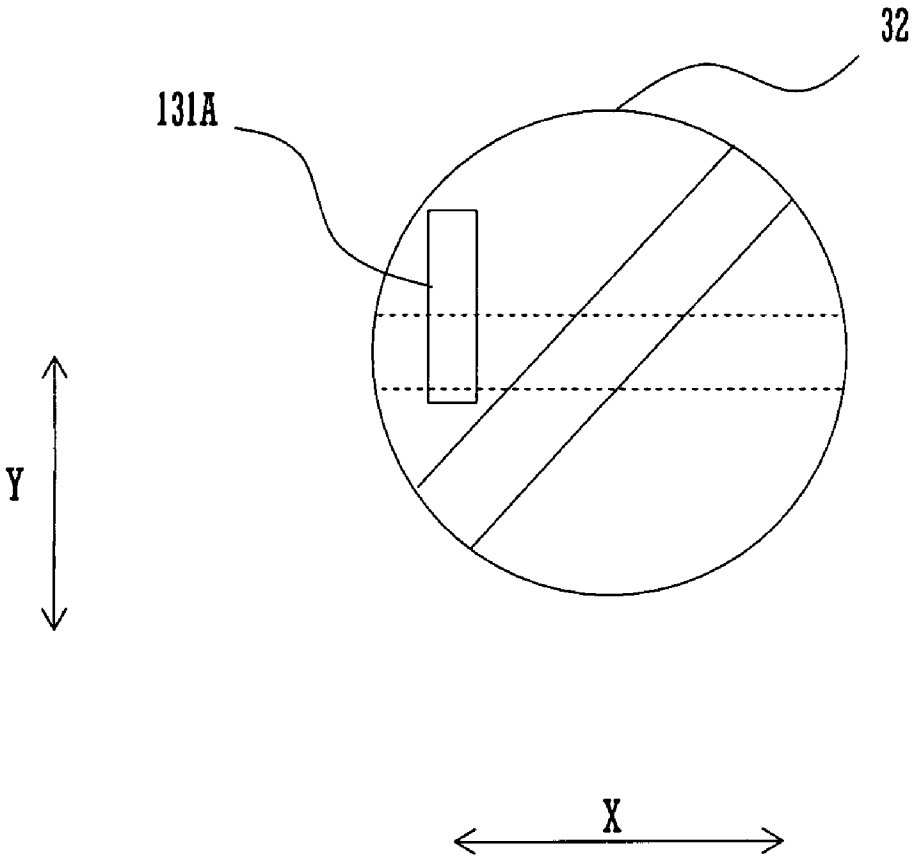
FIG. 12 is a figure showing a front view of the positional relationship of the operating unit and a contacting unit, when the front panel has been closed.

FIG. 11 is a schematic figure showing, as seen from the side, the structure of the image forming device 100 in the state in which the front panel 131 is opened. And FIG. 12 is a figure showing the positional relationship of a contacting unit 131A and the operating member 32, in the state in which the front panel 131 is opened.

The front panel 131 is provided with this contacting unit 131A in a position which faces the operating member 32 when the front panel 131 is closed. This contacting unit 131A confronts a hollow portion of the operating member 32 when the operating member is positioned in its second operating position, as shown in FIG. 12 by the solid line, and moreover is formed to have such a length that it does not contact against the hollow portion of the operating member 32. By contrast, when the operating member 32 is rotated to any position other than its second operating position, as shown in FIG. 12 by the broken line, then the contacting unit 131A contacts against a protruding portion which is formed in the shape of a straight line along the diametrical direction of the operating member 32. Due to this, it is not possible to close the front panel 131 in the state in which operating member 32 is rotated to any position other than its second operating position. And, because of this, it is possible to prevent the front panel 131 from being closed unless rotational operation of the operating member to its second operating position is performed. As a result, it is possible to prevent the front panel 131 from being closed unless the opening/closing members 36 and 37 are rotated to their opened positions. It should be understood that while, in this embodiment, by way of example, a case has been explained in which the contacting unit 131A is provided to the front panel 131, it would also be acceptable not to provide any such contacting unit 131A, if there is no requirement to regulate the opening and closing operation of the front panel 131 according to the opened or closed state of the operating member 32.

All of the features described in the explanation of this embodiment given above are only cited by way of example, and must not be viewed as being limitative of the present technology in any way. The scope of the present technology is not defined by the embodiment described above, but only by the range of the Claims. Moreover, all changes which are equivalent in meaning and scope to the scope of the Claims, are intended to be included within the range of the present technology.

What is claimed is:

1. A toner recovery unit which is detachably installed to a device body having a plurality of discharge outlets through which toner is discharged, comprising:

a storage unit for storing toner;

a frame member for forming a discharge passage which connects said discharge outlets to said storage unit;

an operating member supported by said frame member in such a manner as to be able to be shifted between a first operating position and a second operating position;

a plurality of first opening/closing members provided in such a manner as to correspond to said plurality of discharge outlets respectively, the plurality of first opening/closing members being displaced between opened positions for communicating said plurality of discharge outlets to said discharge passage, and closed positions for not communicating said plurality of discharge outlets to said discharge passage;

an engagement member capable to move between an engagement position and an engagement release position and supported at an engagement portion of said device body by engaging with the engagement portion of said device body at the engaging position; and a shift member biasing said engagement member from its said engagement release position to its said engagement position, and also displacing said first opening/closing members from their said closed positions to their said opened positions in conjunction with the shift of said operating member from its said first operating position to its said second operating position.

2. A toner recovery unit according to claim 1, wherein said shift member displaces said first opening/closing members from their said closed positions to their said opened positions, after having biased said engagement member to its said engagement position.

3. A toner recovery unit according to claim 2, wherein said shift member comprises a regulation member which regulates the shifting of said shift member by engaging with said frame member when said toner recovery unit is not installed to said device body, and whose engagement with said frame member is released when said toner recovery unit is installed to said device body.

4. A toner recovery unit according to claim 3, wherein said frame member rotatably supports said operating member and said plurality of first opening/closing members, and reciprocatably supports said shift member; and wherein, after the rotational shifting of said operating member has been converted into reciprocating shifting, said shift member transmits said shifting to said plurality of first opening/closing members as rotational shifting.

5. A toner recovery unit according to claim 2, wherein said frame member rotatably supports said operating member and said plurality of first opening/closing members, and reciprocatably supports said shift member; and wherein, after the rotational shifting of said operating member has been converted into reciprocating shifting, said shift member transmits said shifting to said plurality of first opening/closing members as rotational shifting.

6. A toner recovery unit according to claim 1, wherein said shift member comprises a regulation member which regulates the shifting of said shift member by engaging with said frame member when said toner recovery unit is not installed to said device body, and whose engagement with said frame member is released when said toner recovery unit is installed to said device body.

7. A toner recovery unit according to claim 6, wherein said frame member rotatably supports said operating member and said plurality of first opening/closing members, and reciprocatably supports said shift member; and wherein, after the rotational shifting of said operating member has been converted into reciprocating shifting, said shift member transmits said shifting to said plurality of first opening/closing members as rotational shifting.

8. A toner recovery unit according to claim 1, wherein said shift member comprises a regulation member which regulates the shifting of said shift member by engaging with said frame member when said toner recovery unit is not installed to said device body, and whose engagement with said frame member is released when said toner recovery unit is installed to said device body.

9. A toner recovery unit according to claim 8, wherein said frame member rotatably supports said operating member and said plurality of first opening/closing members, and reciprocatably supports said shift member; and wherein, after the rotational shifting of said operating member has been converted into reciprocating shifting, said shift member transmits said shifting to said plurality of first opening/closing members as rotational shifting.

10. An image forming device which performs image forming processing using toner, and which has a plurality of discharge outlets which discharge residual toner after having performing image forming processing, comprising:

a toner recovery unit according to claim 8; and a facing member displaceably supported between a shielding position in which, when said toner recovery unit is installed, it covers over said toner recovery unit, and an opened position in which it does not cover over said toner recovery unit, and which has a contacting unit which, when said facing member is displaced to its said shielding position, does not contact against said operating unit, only when said operating unit is positioned in its said second operating position.

11. A toner recovery unit according to claim 1, wherein said frame member rotatably supports said operating member and said plurality of first opening/closing members, and reciprocatably supports said shift member; and wherein, after the rotational shifting of said operating member has been converted into reciprocating shifting, said shift member transmits said shifting to said plurality of first opening/closing members as rotational shifting.

12. A toner recovery unit according to claim 1, wherein said frame member rotatably supports said operating member and said plurality of first opening/closing members, and reciprocatably supports said shift member; and wherein, after the rotational shifting of said operating member has been converted into reciprocating shifting, said shift member transmits said shifting to said plurality of first opening/closing members as rotational shifting.

13. An image forming device which performs image forming processing using toner, and which has a plurality of discharge outlets which discharge residual toner after having performing image forming processing, comprising:

a toner recovery unit according to claim 1;

a plurality of conduits for conveying toner, provided to said plurality of discharge outlets; and second opening/closing members which are inserted into said plurality of conduits and which can be displaced between opened positions in which they open said discharge outlets and closed positions in which they close said discharge outlets, which are formed so as, when said toner recovery unit is installed, to be able to fit into said first opening/closing members of said toner recovery unit only when their mutual open/closed positions agree with one another, and which operate to be displaced together with said first opening/closing members.

* * * * *